US006517217B1

(12) United States Patent
Liao

(10) Patent No.: US 6,517,217 B1
(45) Date of Patent: Feb. 11, 2003

(54) ORNAMENTAL SOLAR LAMP ASSEMBLY

(75) Inventor: Fu-Tie Liao, Taipei (TW)

(73) Assignee: Hwa Hsia Glass Co., Ltd., Hsin Chu (TW)

( * ) Notice: Subject to any disclaimer, the term of this patent is extended or adjusted under 35 U.S.C. 154(b) by 0 days.

(21) Appl. No.: 09/664,354

(22) Filed: Sep. 18, 2000

(51) Int. Cl.[7] ..... F21V 17/00

(52) U.S. Cl. ..... 362/235; 362/800; 362/183; 362/186; 362/252; 362/363

(58) Field of Search ..... 362/183, 186, 362/363, 235, 244, 248, 250, 252, 240

(56) References Cited

U.S. PATENT DOCUMENTS 5,890,794 A * 4/1999 Abtahi et al. ..... 362/294
6,013,985 A * 1/2000 Green et al. ..... 315/149
6,027,225 A * 2/2000 Martin et al. ..... 362/183
6,174,070 B1 * 1/2001 Takamura et al. ..... 362/183
6,290,367 B1 * 9/2001 Greenhoe et al. ..... 362/183
6,338,565 B1 * 1/2002 Fager et al. ..... 362/363
6,227,679 B1 * 5/2002 Zhang et al. ..... 362/236

* cited by examiner

*Primary Examiner*—Sandra O'Shea
*Assistant Examiner*—Anabel Ton
(74) *Attorney, Agent, or Firm*—Leong C. Lei

(57) ABSTRACT

An ornamental solar lamp assembly is constructed to include a hollow base frame holding a solar collector and lamp circuit unit, and a lampshade covered on the base frame, the lampshade admitting light and, having a threaded neck threaded into female threads in an annular groove on the top side wall of the base frame, the solar collector and lamp circuit unit having a solar collector panel mounted on the top side wall of the base frame, a battery mounted inside the base frame, lead-out wires extended from the battery and suspended above the base frame within the lampshade, a plurality of LEDs installed in the lead-out wires, and a control circuit adapted to turn on the LEDs when dark.

2 Claims, 5 Drawing Sheets

ORNAMENTAL SOLAR LAMP ASSEMBLY

BACKGROUND OF THE INVENTION

1. Field of the Invention

The present invention relates to lamps, and more specifically to an ornamental solar lamp assembly, which comprises a hollow base frame holding a solar collector and lamp circuit unit, and a lampshade fastened to the base frame by a screw joint. The ornamental solar lamp assembly converts the radiant energy of sunlight into electric power for the battery in the daytime, and turns on LEDs when dark.

2. Description of the Prior Art

A variety of Christmas tree light sets and decorative lamp assemblies have been disclosed, and have appeared on the market. These Christmas tree light sets and decorative lamp assemblies are commonly comprised of a set of electric wires adapted to receive electric power from an electric outlet, and a set of lights installed in the electric wires. When a Christmas tree light set or decorative lamp assembly is installed in a tree or decorative support means, the electric wires are exposed to the outside, leaving a very bad impression to the beholder. Further, the conventional Christmas tree light set and decorative lamp assemblies cannot be used in places far away from the electric outlets.

SUMMARY OF THE INVENTION

The present invention relates to lamps, and more specifically to an ornamental solar lamp assembly, which comprises a hollow base frame holding a solar collector and lamp circuit unit, and a lampshade fastened to the base frame by a screw joint. The ornamental solar lamp assembly converts the radiant energy of sunlight into electric power for the battery in the daytime, and turns on LEDs when dark.

According to one aspect of the present invention, the ornamental solar lamp assembly is comprised of a hollow base frame holding a solar collector and lamp circuit unit, and a lampshade covered on the base frame, the lampshade admitting light and, having a threaded neck threaded into female threads in an annular groove on the top side wall of the base frame, the solar collector and lamp circuit unit having a solar collector panel mounted on the top side wall of the base frame, a battery mounted inside the base frame, lead-out wires extended from the battery and suspended above the base frame within the lampshade, a plurality of LEDs installed in the lead-out wires, and a control circuit adapted to turn on the LEDs when dark. According to another aspect of the present invention, any of a variety of suitable waste, light-permeable containers that have a threaded neck fitting the female threads in the annular groove of the base frame can be used as a lampshade. According to still another aspect of the present invention, the hollow base frame has a screw hole on the bottom side wall of the bottom cover thereof for mounting. According to still another aspect of the present invention, the lead-out wires can be curved in different directions to hold the LEDs in different angles and positions.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
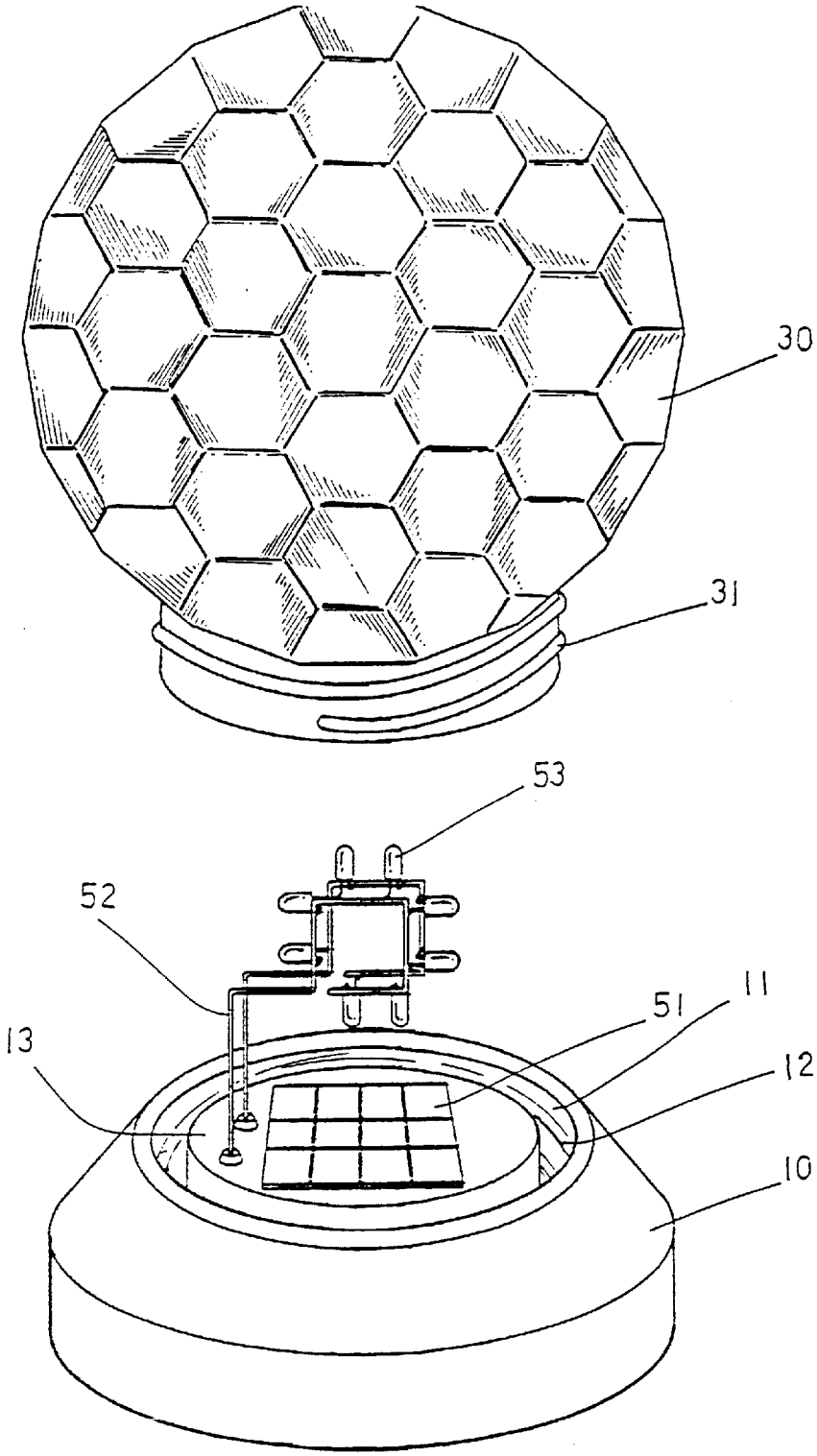
FIG. 1 is an exploded view of an ornamental solar lamp assembly constructed according to one embodiment of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
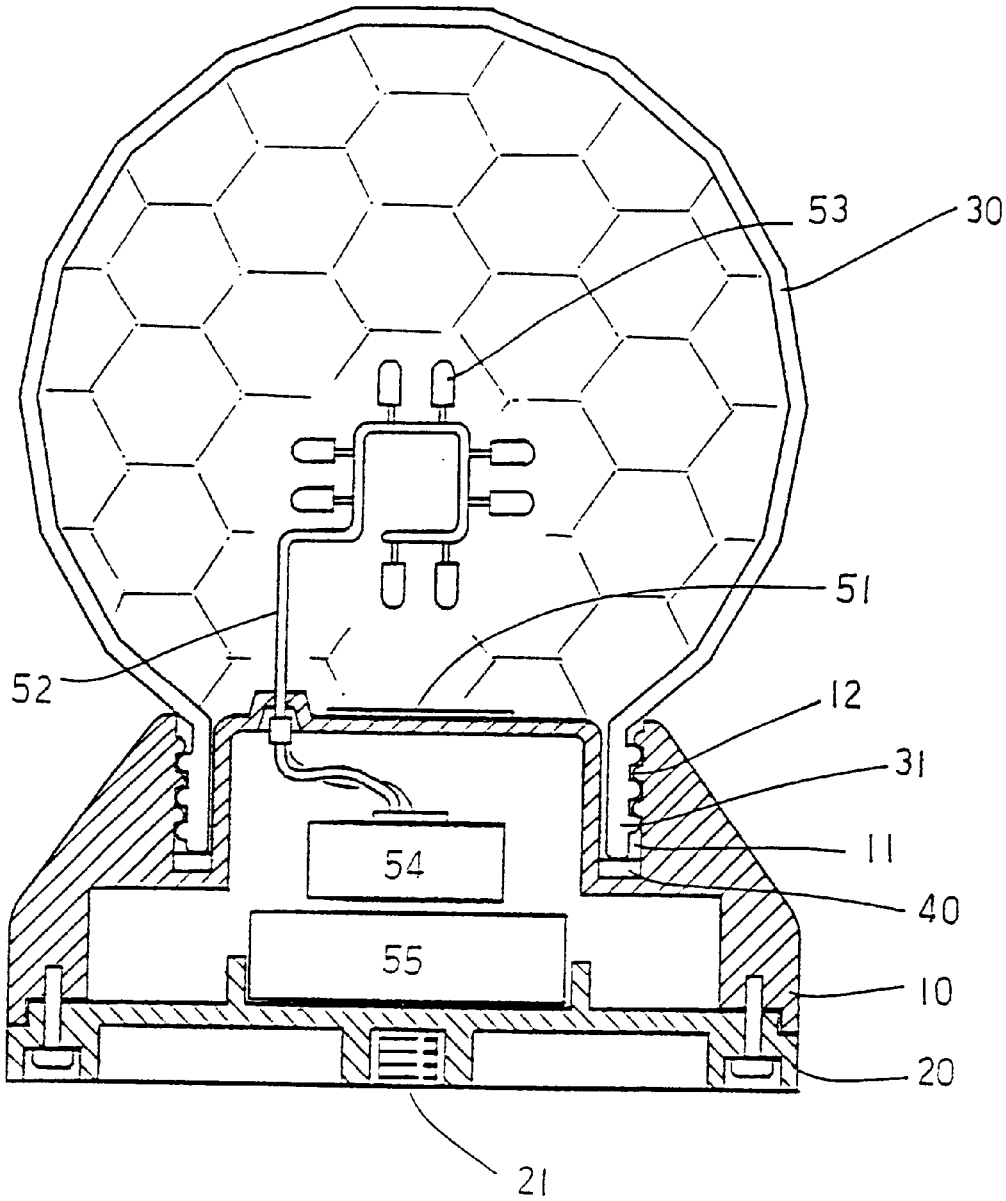
FIG. 2 is a sectional assembly view of the ornamental solar lamp assembly shown in FIG. 1.

Referring to FIGS. 1 and 2, an ornamental solar lamp assembly in accordance with the present invention is generally comprised of a hollow base frame 10, a bottom cover 20, a lampshade 30, a gasket 40, and a solar collector and lamp circuit unit. The base frame 10 comprises an annular groove 11 formed on the top side wall 13 thereof, female threads 12 formed in the annular groove 11 and adapted to receive the lampshade 30. The lampshade 30 is a hollow shell made of glass, acrylic or the like that admits light, comprising a threaded neck 31 adapted for threading into the female threads 12 in the annular groove 11 of the base frame 10. The bottom cover 20 is fastened to the bottom side of the base frame 10, comprising a bottom screw hole 21 at the center of the bottom side thereof for mounting. By means of the bottom screw hole 21, the ornamental solar lamp assembly can be fastened to a supporting screw rod. The solar collector and lamp circuit unit comprises a battery 55 mounted on the bottom cover 20 and disposed inside the base frame 10, a solar-collector panel 51 fixedly mounted on the top side wall 13 of the base frame 10 and adapted to convert the radiant energy of sunlight into electric power and to charge the battery 55 with the electric power thus obtained, positive and negative lead-out wires 52 respectively extended from the battery 55 and suspended above the top side wall 13 of the base frame 10, a plurality of LEDs (light emitting diodes) 53 connected to the lead-out wires 52, and a control circuit 54 adapted to control the transmission of battery power supply from the battery 55 to the LEDs 53 through the lead-out wires 52. The control circuit 54 comprises photo sensor means adapted to detect the intensity of ambient light, and to turn on/off the power passage between the battery 55 and the lead-out wires 52 subject to the intensity of ambient light, i.e., when the power passage between the battery 55 and the lead-out wires 52 is off and the LEDs 53 are turned off when in the daytime, the power passage between the battery 55 and the lead-out wires 52 is on and the LEDs 53 are turned on when at night.

Figure 3:
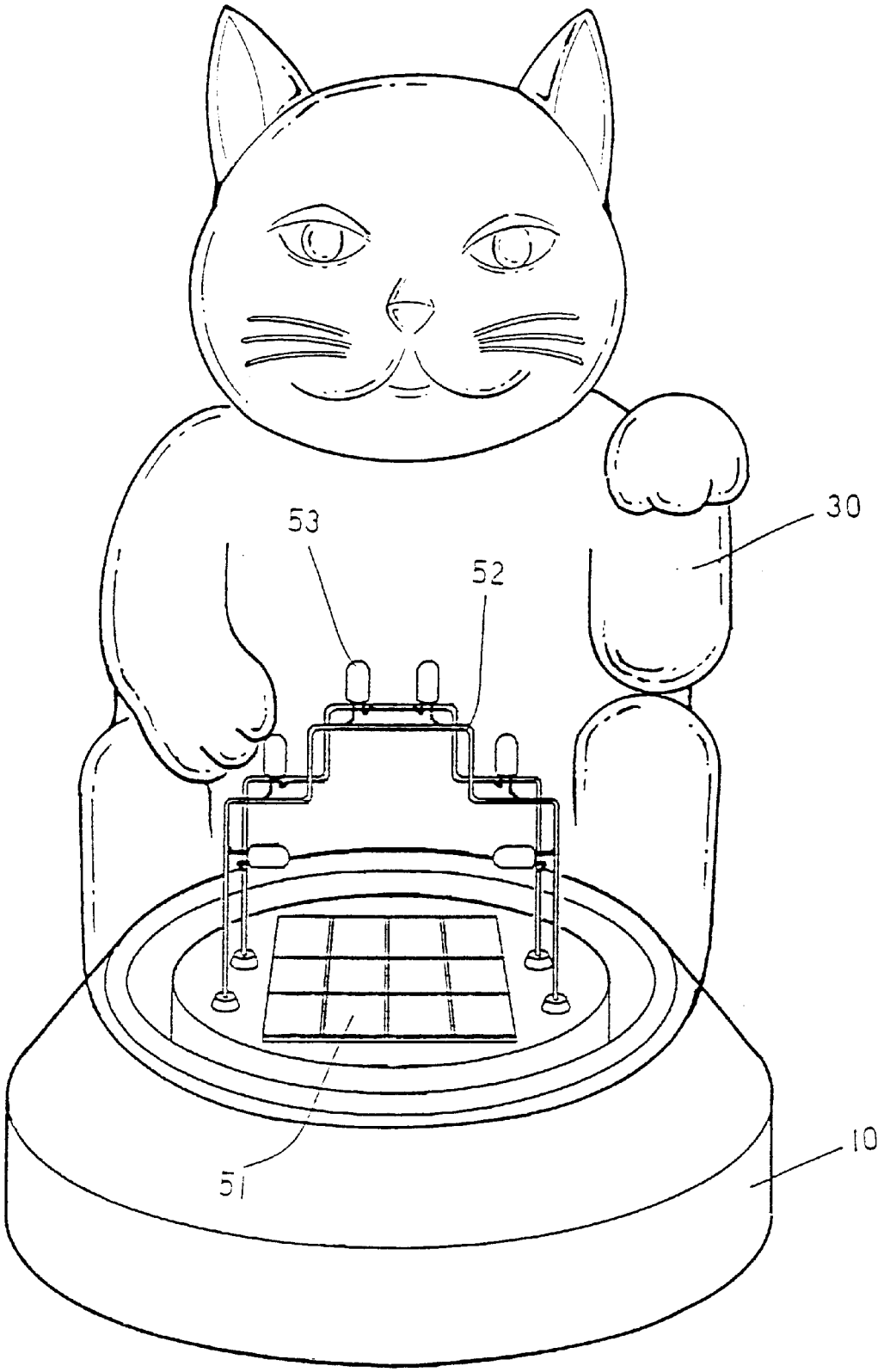
FIG. 3 is a perspective view of an ornamental solar lamp assembly according to an alternate form of the present invention.

The aforesaid lampshade 30 can have any of a variety of shapes. For example, in FIGS. 1 and 2, the lampshade 30 has a spherical shape; in FIG. 3, the lampshade 30 has the shape of a sitting cat; in FIG. 5, the lampshade 30 has the shape of a doll. Further, the lead-out wires 52 can be bent and held in a curved condition to hold the LEDs 53 in different angles and positions.

Figure 4:
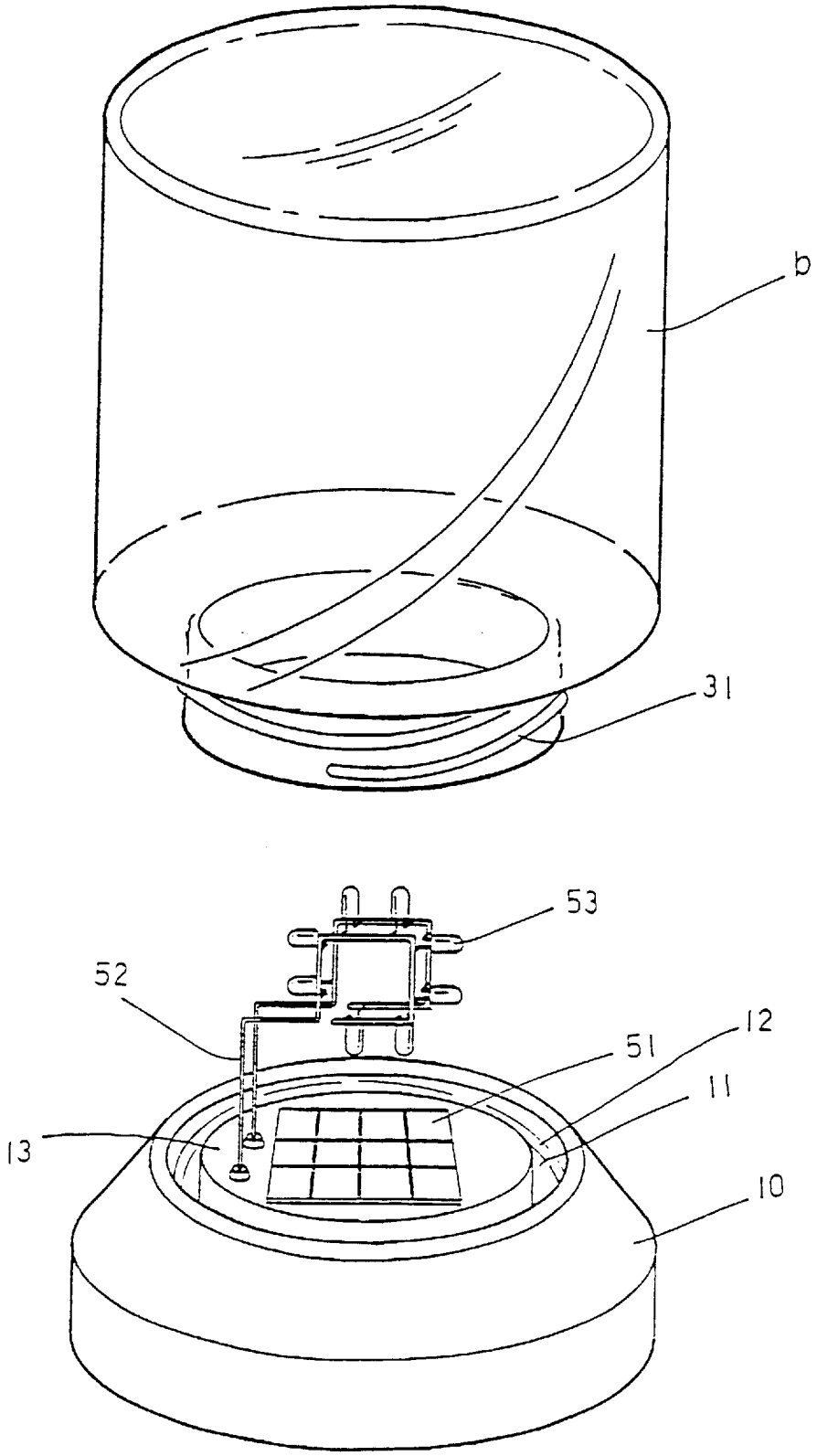
FIG. 4 is an exploded view of an ornamental solar lamp assembly according to another alternate form of the present invention.

Referring to FIG. 4, the annular groove 11 and the threads 12 are constructed to fit the threaded neck 31 of a glass container b, so that the glass container b can be used as a lampshade instead of the aforesaid lampshade 30.

Figure 5:
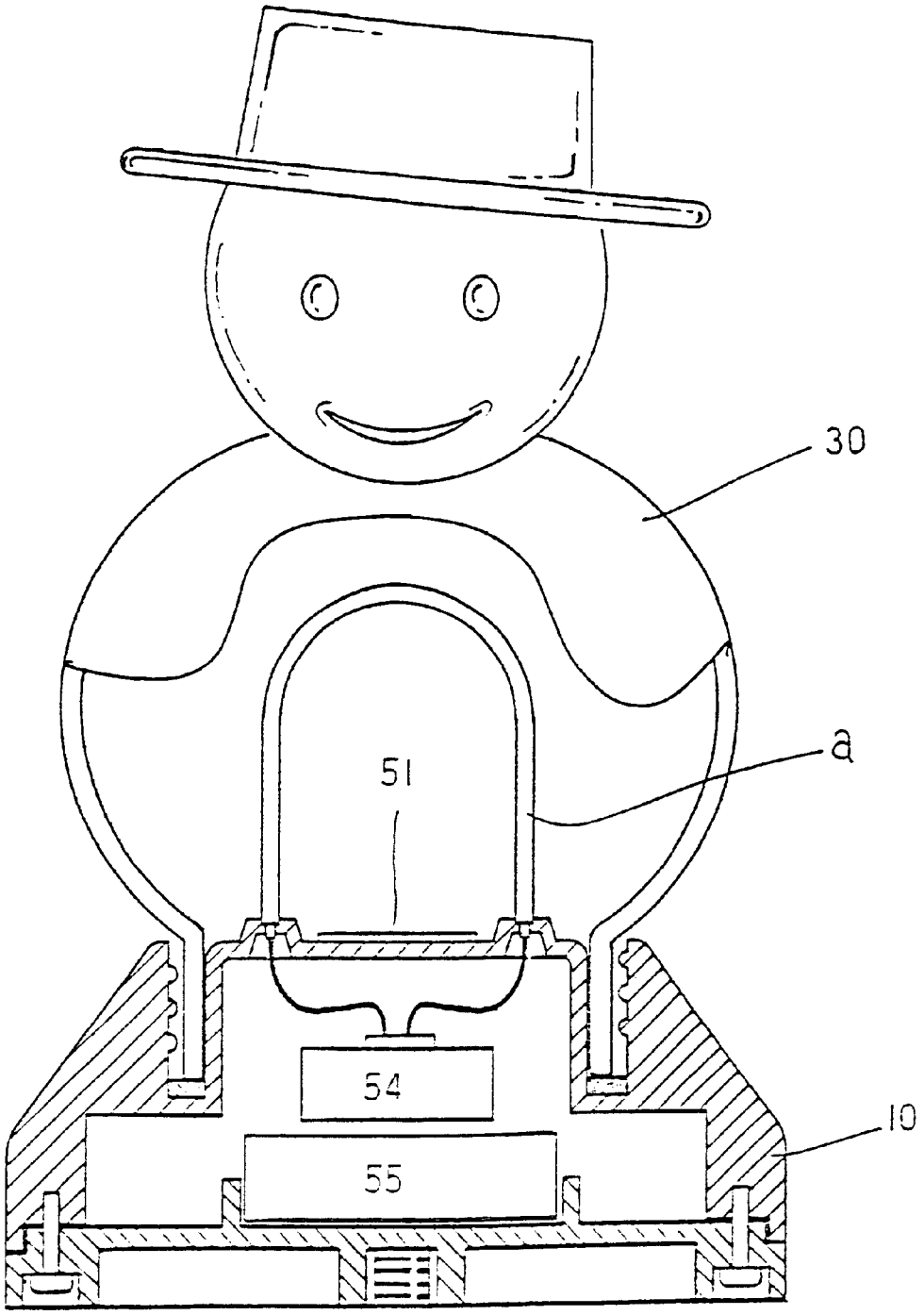
FIG. 5 is a sectional view of an ornamental solar lamp assembly according to still another alternate form of the present invention.

Referring to FIG. 5, a cold-cathode tube a may be used instead of the aforesaid LEDs 53, and connected to the battery 55 through the control circuit 54.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An ornamental solar lamp assembly comprising:

a hollow base frame covered with a bottom cover, said base frame comprising an annular groove formed on a top side wall thereof and female threads formed in said annular groove;

a solar collector and lamp circuit unit installed in said base frame, said solar collector and lamp circuit unit comprising a battery mounted on said bottom cover and disposed inside said base frame, a solar-collector panel fixedly mounted on the top side wall of said base frame and adapted to convert the radiant energy of sunlight into electric power and to charge said battery with obtained electric power, positive and negative lead-out wires respectively extended from said battery and suspended above the top side wall of said base frame, light emitting means connected to said lead-out wires, and a control circuit adapted to control the transmission of battery power supply from said battery to said light emitting means through said lead-out wires;

a lampshade fastened to the top side wall of said base frame and covered over said light emitting means, said lampshade admitting light and, comprising a threaded neck threaded into said female threads in said annular groove of said base frame;

said bottom cover comprising a bottom screw hole for mounting; and said light emitting means being comprised of a plurality of light emitting diodes, and said lead-out wires being curved in different directions to hold said light emitting diodes in different angles.

2. The ornamental solar lamp assembly as claimed in claim 1, wherein said light emitting means is comprised of a cold-cathode tube.

* * * * *